US012258976B2

(12) United States Patent
Furutani

(10) Patent No.: US 12,258,976 B2
(45) Date of Patent: Mar. 25, 2025

(54) AXIAL FAN

(71) Applicants: KABUSHIKI KAISHA TOSHIBA, Tokyo (JP); Toshiba Carrier Corporation, Kawasaki (JP)

(72) Inventor: Yuki Furutani, Hiratsuka (JP)

(73) Assignees: KABUSHIKI KAISHA TOSHIBA, Tokyo (JP); Toshiba Carrier Corporation, Kawasaki (JP)

( * ) Notice: Subject to any disclaimer, the term of this patent is extended or adjusted under 35 U.S.C. 154(b) by 0 days.

(21) Appl. No.: 18/493,093

(22) Filed: Oct. 24, 2023

(65) Prior Publication Data

US 2024/0271637 A1 Aug. 15, 2024

(30) Foreign Application Priority Data

Feb. 15, 2023 (JP) ..... 2023-021721

(51) Int. Cl.
*F04D 29/54* (2006.01)
*F04D 19/00* (2006.01)
*F04D 29/52* (2006.01)

(52) U.S. Cl.
CPC ..... *F04D 29/526* (2013.01); *F04D 19/002* (2013.01); *F04D 29/541* (2013.01)

(58) Field of Classification Search
CPC ..... F04D 29/526; F04D 19/002; F04D 29/541
See application file for complete search history.

(56) References Cited

U.S. PATENT DOCUMENTS

| | | | | |
|---|---|---|---|---|
| 11,434,929 | B2 * | 9/2022 | Hoffman | F04D 29/663 |
| 11,841,023 | B2 * | 12/2023 | Hoffman | F04D 29/664 |
| 2016/0146217 | A1 * | 5/2016 | Tadokoro | F04D 29/547 415/121.2 |
| 2018/0335055 | A1 * | 11/2018 | Goto | F04D 29/687 |
| 2021/0033115 | A1 * | 2/2021 | Hoffman | F04D 29/663 |
| 2022/0316500 | A1 * | 10/2022 | Hoffman | F04D 29/664 |

FOREIGN PATENT DOCUMENTS

| | | | | |
|---|---|---|---|---|
| JP | 8-135600 A | | 5/1996 | |
| JP | 9-264296 A | | 10/1997 | |
| JP | H10148199 A | * | 6/1998 | F04D 29/526 |
| JP | 2000-110790 A | | 4/2000 | |
| JP | 2010-229871 A | | 10/2010 | |

* cited by examiner

*Primary Examiner* — Aaron R Eastman
(74) *Attorney, Agent, or Firm* — Oblon, McClelland, Maier & Neustadt, L.L.P.

(57) ABSTRACT

An axial fan includes: an impeller including a rotating part, and a blade part connected to the rotating part; a bellmouth including a flat part orthogonal to an extension direction of a rotation axis of the rotating part; a rising part rising from the flat part; and an opening along which the rising part extends, the impeller being located in the opening, the rising part surrounding the impeller, the bellmouth including a plurality of grooves located at a surface of the bellmouth, the surface of the bellmouth being connected to an inner surface of the rising part, the inner surface of the rising part facing the blade part of the impeller, the plurality of grooves being located in at least a corner portion connecting the flat part and the rising part, the plurality of grooves extending in a direction crossing the flat part.

7 Claims, 6 Drawing Sheets

AXIAL FAN

CROSS-REFERENCE TO RELATED APPLICATION

This application is based upon and claims the benefit of priority from Japanese Patent Application No. 2023-021721, filed on Feb. 15, 2023; the entire contents of which are incorporated herein by reference.

FIELD

Embodiments described herein relate generally to an axial fan.

BACKGROUND

It is desirable to improve the blower capacity of an axial fan used in air conditioners and the like.

DETAILED DESCRIPTION

Figure 1:
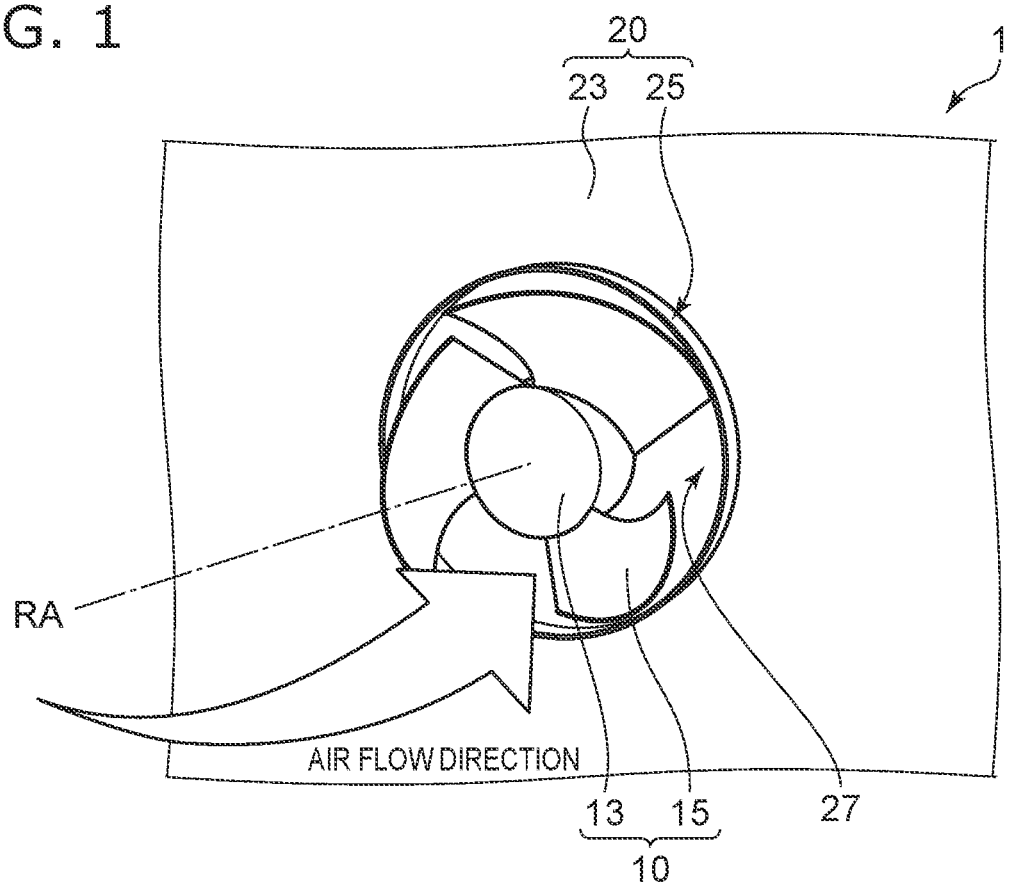
FIG. 1 is a schematic view showing an axial fan 1 according to an embodiment.

In general, according to one embodiment, an axial fan includes: an impeller including a rotating part, and a blade part connected to the rotating part; a bellmouth including a flat part orthogonal to an extension direction of a rotation axis of the rotating part; a rising part rising from the flat part; and an opening along which the rising part extends, the impeller being located in the opening, the rising part surrounding the impeller, the bellmouth including a plurality of grooves located at a surface of the bellmouth, the surface of the bellmouth being connected to an inner surface of the rising part, the inner surface of the rising part facing the blade part of the impeller, the plurality of grooves being located in at least a corner portion connecting the flat part and the rising part, the plurality of grooves extending in a direction crossing the flat part.

Exemplary embodiments will now be described with reference to the drawings. The same portions in the drawings are marked with the same numerals; a detailed description is omitted as appropriate; and different portions are described. The drawings are schematic or conceptual; and the relationships between the thickness and width of portions, the proportions of sizes among portions, etc., are not necessarily the same as the actual values. The dimensions and proportions may be illustrated differently among drawings, even when the same portion is illustrated.

FIG. 1 is a schematic view showing an axial fan 1 according to an embodiment. For example, the axial fan 1 is used in an air conditioner.

The axial fan 1 includes an impeller 10 and a bellmouth 20. The impeller 10 includes a rotating part 13, a blade part 15 connected to the rotating part 13, and a rotation axis RA passing through the center of the rotating part 13. The bellmouth 20 includes a flat part 23, a rising part 25, and an opening 27 surrounded with the rising part 25. The opening 27 is a substantially circular opening; and the impeller 10 is located in the opening 27. The impeller 10 and the bellmouth 20 are, for example, molded resins. The impeller 10 and the bellmouth 20 are not limited to resins and may be metals such as aluminum, etc.

The flat part 23 is orthogonal to the extension direction of the rotation axis RA of the impeller 10. The rising part 25 rises from the flat part 23 and extends along the opening 27. For example, the flat part 23 and the rising part 25 are formed to have a continuous body. At least a portion of the impeller 10 is surrounded with the rising part 25.

Figure 5:
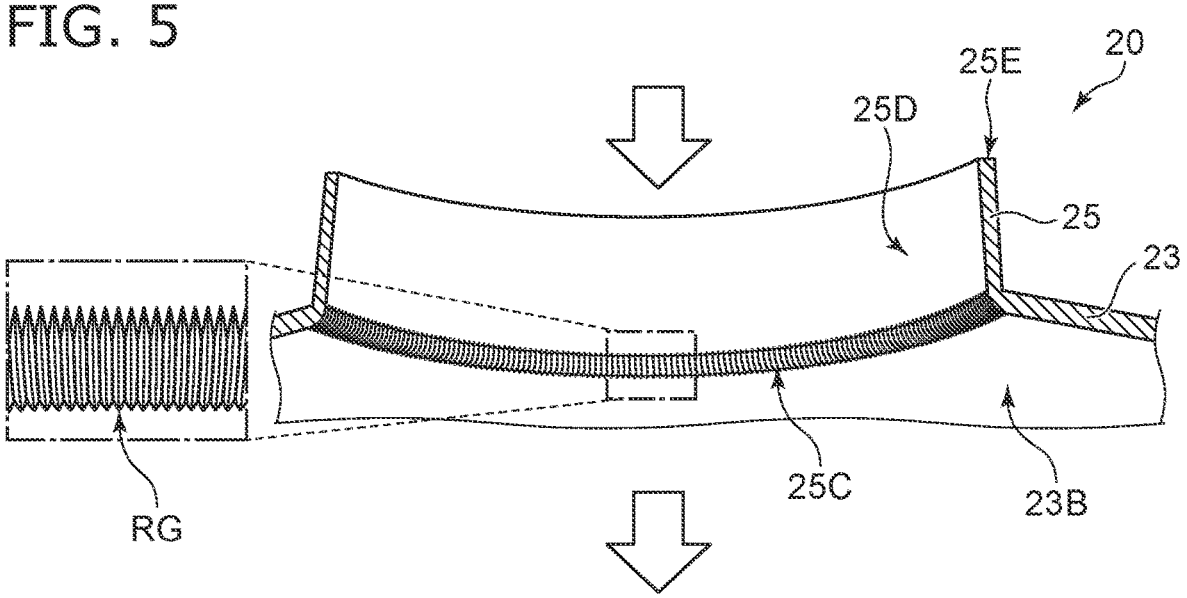
FIG. 5 is a partial schematic view of the axial fan according to the embodiment.

The bellmouth 20 includes multiple grooves RG (see FIG. 5) located at a surface of the bellmouth 20 connected to the inner surface of the rising part 25 that faces the blade part 15 of the impeller 10 (see FIG. 5). The multiple grooves RG are located in at least a corner portion 25C connecting the flat part 23 and the rising part 25, and extend in a direction crossing the flat part 23.

Figure 2A:
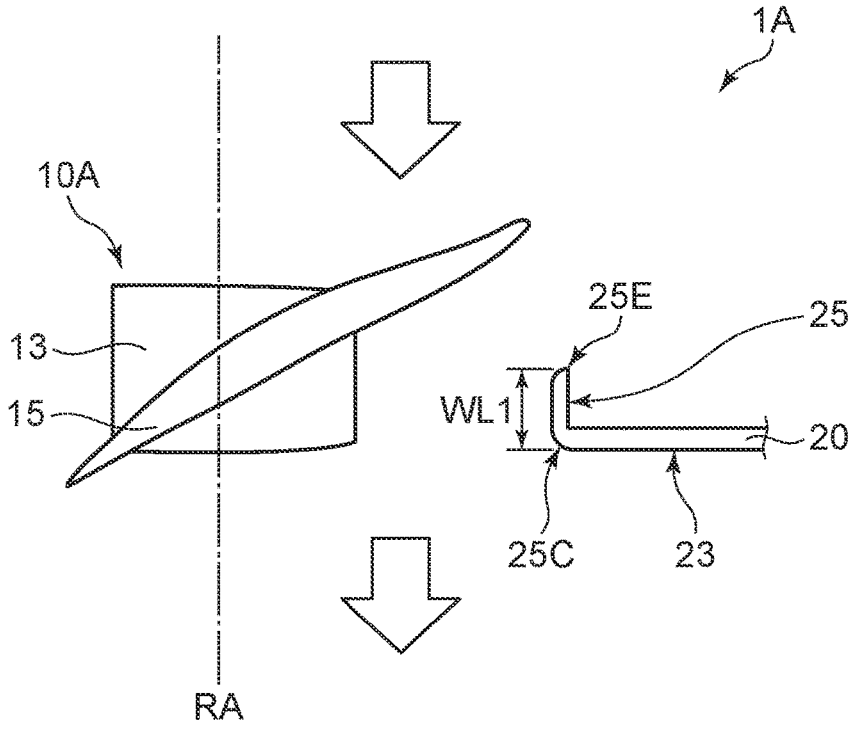
FIGS. 2A and 2B are schematic views showing characteristics of an axial fan according to an embodiment.
Figure 2B:
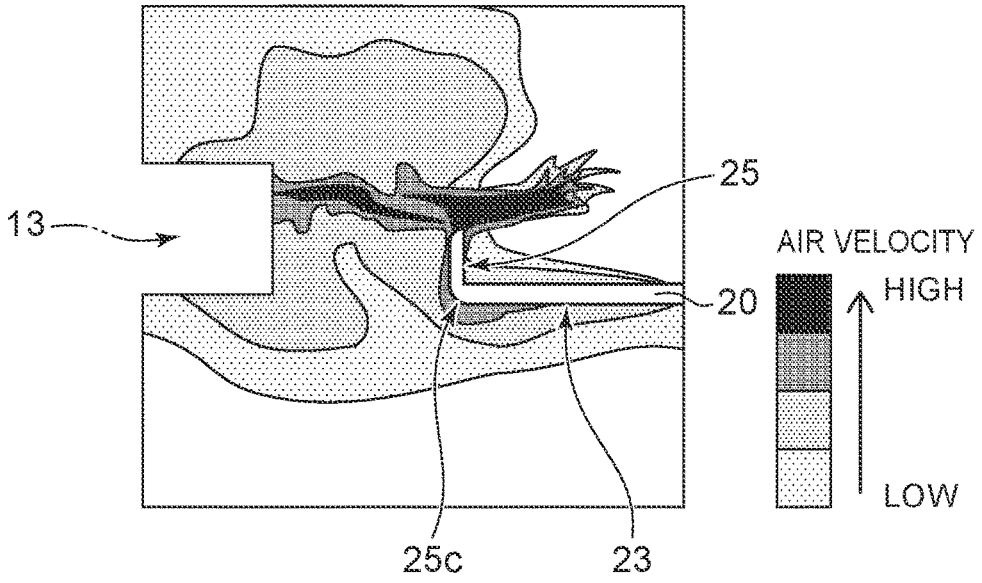

FIGS. 2A and 2B are schematic views showing characteristics of an axial fan 1A according to an embodiment. FIG. 2A is a schematic cross-sectional view showing the axial fan 1A. FIG. 2B is a schematic view showing simulation results of the air velocity at a cross section of the axial fan 1A.

As shown in FIG. 2A, the air flow that is generated by the rotation of the impeller 10 flows in a direction along the rotation axis RA, e.g., in a direction from an end portion 25E of the rising part 25 of the bellmouth 20 toward the corner portion 25C connected with the flat part 23. In other words, the end portion 25E side of the bellmouth 20 is used as the inflow side; and the corner portion 25C side is used as the outflow side.

For example, the rising part 25 of the bellmouth 20 overlaps at least a portion of the blade part 15 of the impeller 10 in a direction orthogonal to the rotation axis RA. Hereinbelow, the width of the rising part 25 in the direction parallel to the rotation axis RA is referred to as the wrap width. In the example, the bellmouth 20 has a wrap width WL1.

For example, the rising part 25 is orthogonal to the flat part 23. In other words, for example, the rising part 25 is parallel to the rotation axis RA. For example, the corner portion 25C that connects the flat part 23 and the rising part 25 has a prescribed curvature at the surface facing the impeller 10.

In FIG. 2B, shading illustrates the air velocity distribution. The air velocity is fastest at the position of rotation of the blade part 15, and decreases at the inflow side and outflow side. At the outflow side, the air velocity is faster at the vicinity of the rotating part 13 of the impeller 10 and the vicinity of the rising part 25 of the bellmouth 20.

Figure 3A:
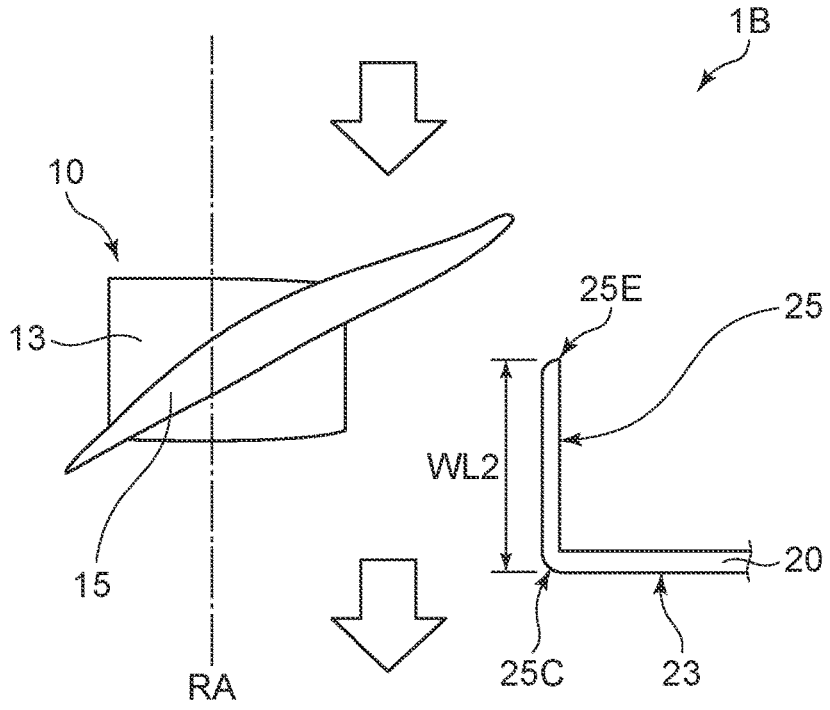
FIGS. 3A and 3B are schematic views showing characteristics of an axial fan according to an embodiment.
Figure 3B:
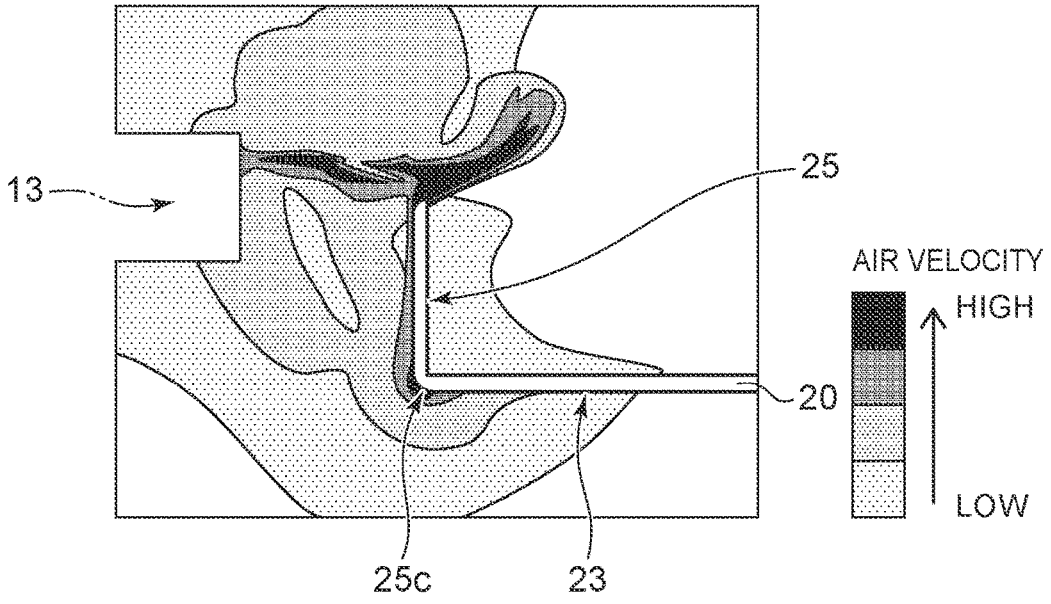

FIGS. 3A and 3B are schematic views showing characteristics of an axial fan 1B according to an embodiment. FIG. 3A is a schematic cross-sectional view showing the axial fan 1B. FIG. 3B is a schematic view showing simulation results of the air velocity at a cross section of the axial fan 1B.

As shown in FIG. 3A, the bellmouth 20 has a wrap width WL2. The wrap width WL2 is greater than the wrap width WL1 (see FIG. 2A). In the example as well, at least a portion of the rising part 25 of the bellmouth 20 overlaps at least a portion of the blade part 15 of the impeller 10 in a direction orthogonal to the rotation axis RA. The rising part 25 is parallel to the rotation axis RA. The embodiment is not limited to this example; the rising part 25 may be oblique to the rotation axis RA.

In FIG. 3B as well, shading illustrates the air velocity distribution. The air velocity is fastest at the position of rotation of the blade part 15, and decreases at the inflow side and outflow side. At the outflow side, the air velocity is faster at the vicinity of the rotating part 13 of the impeller 10 and the vicinity of the rising part 25 of the bellmouth 20.

It can be seen that in the example, the air velocity at the vicinity of the rising part 25 increases toward the corner portion 25C because the wrap width WL2 is wide. It can be seen that the air velocity at the corner portion 25C has a value near the air velocity at the position of rotation of the blade part 15.

Figure 4:
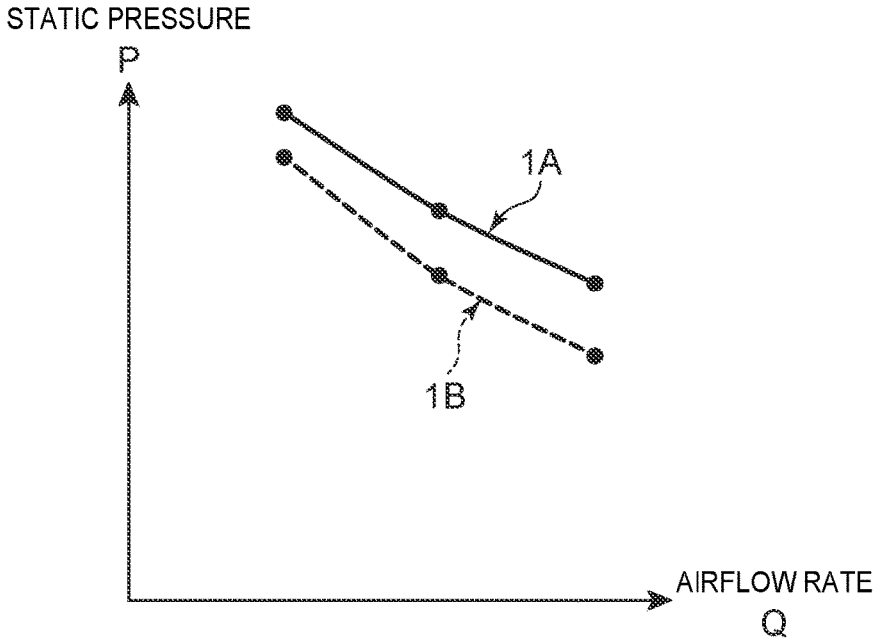
FIG. 4 is a graph showing characteristics of the axial fan according to the embodiment.

FIG. 4 is a graph showing characteristics of the axial fan 1 according to the embodiment. The horizontal axis is an airflow rate Q. The vertical axis is a static pressure P at the outlet side when referenced to the pressure at the inlet side. FIG. 4 illustrates the PQ characteristics of the axial fans 1A and 1B.

As shown in FIG. 4, the static pressure P decreases as the airflow rate Q increases. It can be seen that for the same airflow rate value, the static pressure P of the axial fan 1B is less than the static pressure P of the axial fan 1A. This is because a width WL2 of the rising part 25 of the bellmouth 20 of the axial fan 1B is greater than a width WL1 of the rising part 25 of the bellmouth 20 of the axial fan 1A. In other words, this is because in the axial fan 1B, the air velocity is faster at the vicinity of the rising part 25 (see FIG. 3B), and the wall resistance along the rising part 25 is greater.

It can be seen that consequently, in the axial fan 1, the blower capacity increases as the static pressure P increases. In other words, the blower capacity of the axial fan 1B is less than the blower capacity of the axial fan 1A because the width WL2 of the rising part 25 is greater than the width WL1. On the other hand, from the perspective of safety, there are also cases where it is favorable to widen the rising part 25.

FIG. 5 is a partial schematic view of the axial fan 1 according to the embodiment. FIG. 5 is a schematic view showing a partial cross-section of the bellmouth 20.

As shown in FIG. 5, the bellmouth 20 has the multiple grooves RG provided in the corner portion 25C that connects the flat part 23 and the rising part 25. The multiple grooves RG are provided in the surface of the rising part 25 of the bellmouth 20 connected to an inner surface 25D that faces the impeller 10; and the multiple grooves RG extend in a direction crossing the flat part 23. Specifically, the multiple grooves RG are formed along the corner portion 25C that connects the flat part 23 and the rotation axis RA direction of the impeller 10. The multiple grooves RG extend in a direction crossing a lower surface 23B of the flat part 23 and are arranged along the corner portion 25C. The multiple grooves RG form a so-called riblet structure.

Figure 6:
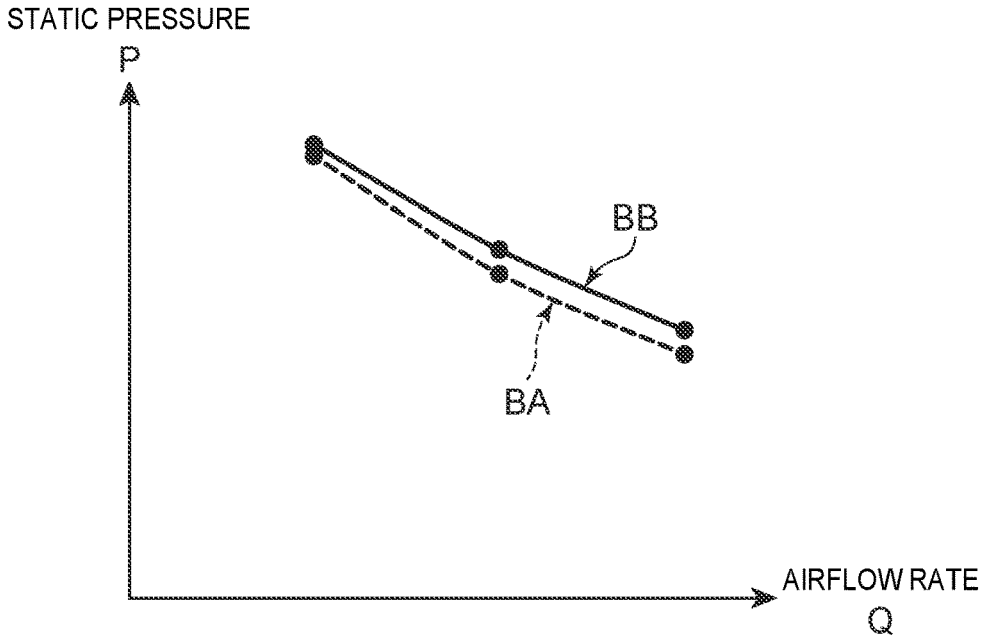
FIG. 6 is another graph showing characteristics of the axial fan according to the embodiment.

FIG. 6 is another graph showing characteristics of the axial fan 1 according to the embodiment. The horizontal axis is the airflow rate Q. The vertical axis is the static pressure P at the outlet side. FIG. 6 shows the characteristic "BA" when the multiple grooves RG are not provided, and the characteristic "BB" when the multiple grooves RG are provided.

As shown in FIG. 6, the static pressure P of the axial fan 1 can be increased by providing the multiple grooves RG. In other words, by forming the riblet structure in the corner portion 25C at which the air velocity near the rising part 25 of the bellmouth 20 is high, the wall resistance can be reduced, and the static pressure P can be increased.

Although the multiple grooves RG are not provided in the axial fan 1A or axial fan 1B shown in FIGS. 2A to 3B, for example, by providing the multiple grooves RG in the corner portion 25C of the bellmouth 20 of the axial fan 1B, the blower capacity can be improved while increasing the static pressure P.

Figure 7A:
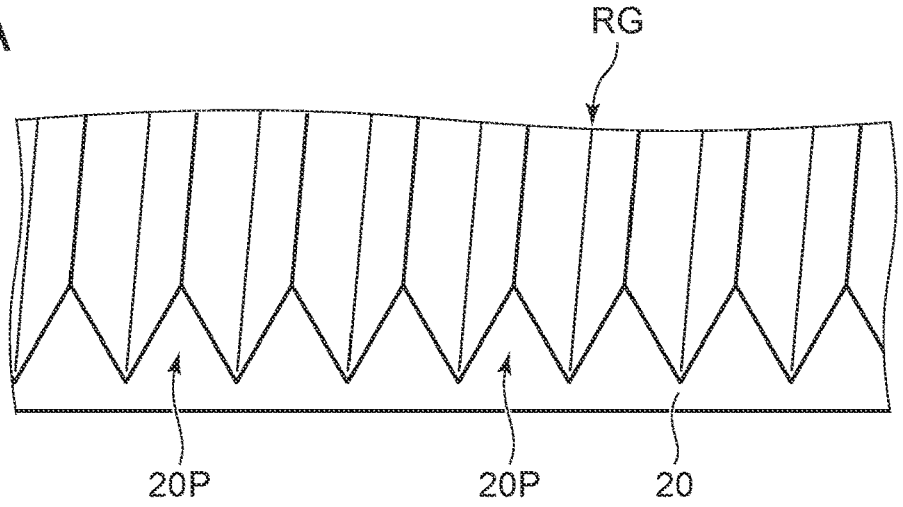
FIGS. 7A and 7B are schematic views showing the structure of the axial fan according to the embodiment.
Figure 7B:
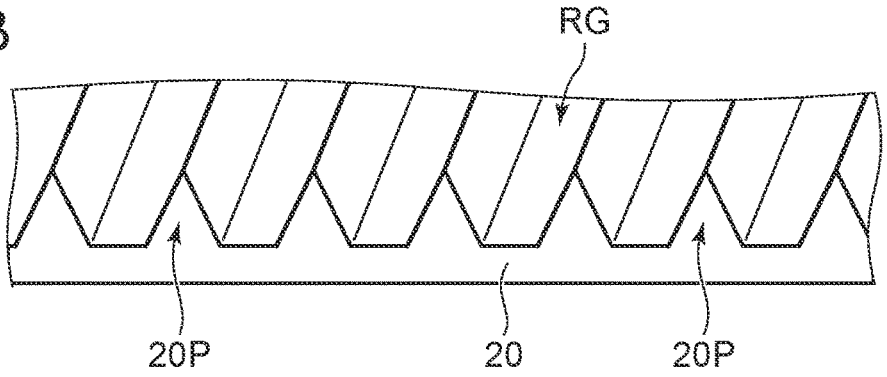

FIGS. 7A and 7B are schematic views showing the structure of the axial fan 1 according to the embodiment. FIGS. 7A and 7B are perspective views showing the multiple grooves RG.

As shown in FIG. 7A, the multiple grooves RG each are located respectively between two adjacent protrusions among multiple protrusions 20P provided in the bellmouth 20. For example, the multiple grooves RG are provided at a constant interval. The protrusions 20P have, for example, triangular cross sections. For example, the protrusions 20P may be molded by providing multiple grooves in the bellmouth mold. Also, the protrusions 20P may be provided by selectively etching the bellmouth 20. Or, a member that is used as the protrusions 20P may be added to the surface of the bellmouth 20.

As shown in FIG. 7B, the multiple protrusions 20P may be provided to be separated from each other. In other words, the wall resistance also can be reduced by providing favorable spacing between the two adjacent protrusions 20P. The shape of the cross section of the protrusion 20P is not limited to triangular and may be, for example, quadrilateral, pentagonal, or trapezoidal.

Figure 8:
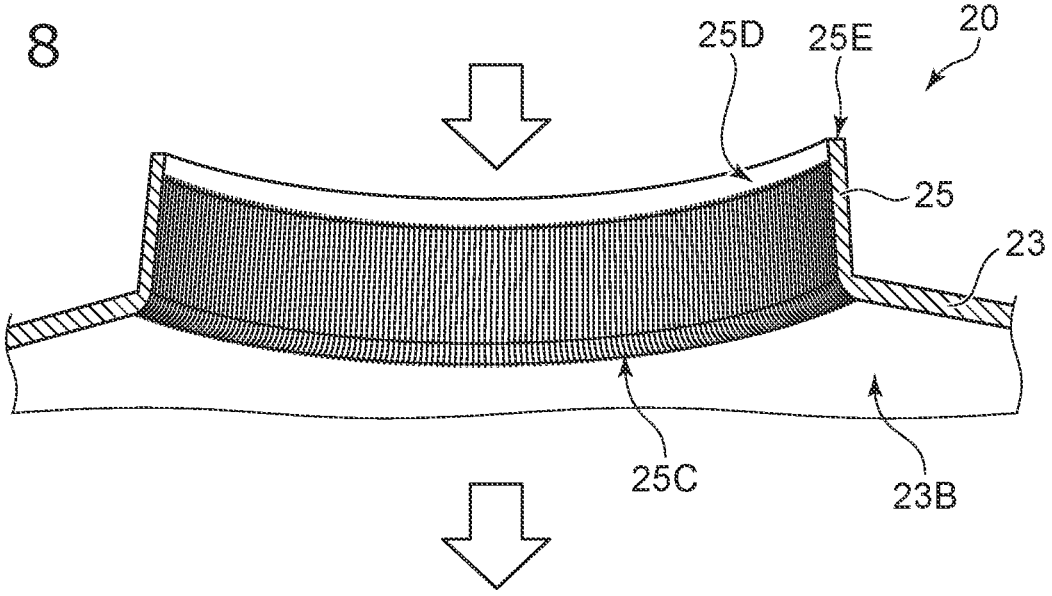
FIG. 8 is a partial schematic view of the axial fan according to a modification of the embodiment.

FIG. 8 is a partial schematic view of the axial fan 1 according to a modification of the embodiment. FIG. 8 is a schematic view showing a partial cross-section of the bellmouth 20.

As shown in FIG. 8, the multiple grooves RG may be provided to extend to the inner surface 25D of the rising part 25 from the corner portion 25C connecting the flat part 23 and the rising part 25. The multiple grooves RG are arranged on the inner surface 25D of the rising part 25 and surround the impeller 10. The wall resistance of the bellmouth 20 is further reduced thereby, and an improvement of the static pressure P is expected.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

Embodiments include the following aspects.

Note 1

An axial fan, comprising:

an impeller including a rotating part, and a blade part connected to the rotating part;

a bellmouth including a flat part orthogonal to an extension direction of a rotation axis of the rotating part;

a rising part rising from the flat part; and an opening along which the rising part extends, the impeller being located in the opening, the rising part surrounding the impeller, the bellmouth including a plurality of grooves located at a surface of the bellmouth, the surface of the bellmouth being connected to an inner surface of the rising part, the inner surface of the rising part facing the blade part of the impeller, the plurality of grooves being located in at least a corner portion connecting the flat part and the rising part, the plurality of grooves extending in a direction crossing the flat part.

Note 2

The fan according to note 1, wherein the plurality of grooves of the bellmouth is arranged along the corner portion connecting the flat part and the rising part.

Note 3

The fan according to note 1 or note 2, wherein the plurality of grooves of the bellmouth extends over the inner surface of the rising part and surrounds the impeller.

Note 4.

The fan according to one of notes 1-3, wherein the plurality of grooves of the bellmouth is periodically arranged along the corner portion connecting the flat part and the rising part.

Note 5.

The fan according to one of notes 1-4, wherein the plurality of grooves of the bellmouth is located respectively between a plurality of protrusions arranged along the corner portion connecting the flat part and the rising part.

Note 6.

The fan according to one of notes 1-6, wherein the plurality of grooves of the bellmouth has a riblet structure.

What is claimed is:

1. An axial fan, comprising:

an impeller including a rotating part, and a blade part connected to the rotating part;

a bellmouth including a flat part orthogonal to an extension direction of a rotation axis of the rotating part;

a rising part rising from the flat part;

a corner portion connecting the flat part and the rising part; and an opening along which the rising part extends, the impeller being located in the opening, the rising part surrounding the impeller, the bellmouth including a plurality of grooves located at a surface of the bellmouth, the surface of the bellmouth being connected to an inner surface of the rising part, the inner surface of the rising part facing the blade part of the impeller, the plurality of grooves extending along an entirety of the corner portion and extending along a portion of each of the flat part and the rising part, the portion of the flat part and the rising part being located immediately adjacent the corner portion.

2. The fan according to claim 1, wherein the plurality of grooves of the bellmouth is arranged along the corner portion connecting the flat part and the rising part.

3. The fan according to claim 1, wherein the plurality of grooves of the bellmouth extends over the inner surface of the rising part and surrounds the impeller.

4. The fan according to claim 1, wherein the plurality of grooves of the bellmouth is periodically arranged along the corner portion connecting the flat part and the rising part.

5. The fan according to claim 1, wherein the plurality of grooves of the bellmouth is located respectively between a plurality of protrusions arranged along the corner portion connecting the flat part and the rising part.

6. The fan according to claim 1, wherein the plurality of grooves of the bellmouth has a riblet structure.

7. The fan according to claim 1, wherein the plurality of grooves extend from an end of the rising part on the flat part side to an end of the flat part on the rising part side.

* * * * *